United States Patent [19]

Cummings, Jr. et al.

[11] 3,954,635

[45] May 4, 1976

[54] POLYGLYCOLIC ACID FIBER FINISH AND METHOD

[75] Inventors: Percival W. Cummings, Jr., Brookfield; John H. Goodman, III, Danbury, both of Conn.; Arthur Glick, Dorado, P.R.; James B. McPherson, Jr., Cos Cob; Edward J. McCusker, Danbury, both of Conn.

[73] Assignee: American Cyanamid Company, Stamford, Conn.

[22] Filed: Dec. 23, 1974

[21] Appl. No.: 535,936

[52] U.S. Cl. ..... 252/8.9; 28/75 R; 128/335.5; 252/8.6 R; 252/8.7; 252/8.75; 260/18; 260/78.3 R; 260/78.3 UA; 264/290 R; 427/394

[51] Int. Cl.[2] ..... D06M 13/22

[58] Field of Search ..... 252/8.6, 8.7, 8.75, 252/8.9; 260/78.3 R, 78.3 UA, 18; 128/335.5; 264/290; 117/139.5; 28/75 R; 427/394

[56] References Cited

UNITED STATES PATENTS

| | | | |
|---|---|---|---|
| 2,695,270 | 11/1954 | Jefferson et al. | 252/8.9 X |
| 3,101,990 | 8/1963 | Heighton | 264/290 X |
| 3,297,033 | 1/1967 | Schmitt et al. | 128/335.5 |
| 3,442,871 | 5/1969 | Schmitt et al. | 260/78.3 |
| 3,565,077 | 2/1971 | Glick | 128/335.5 |
| 3,600,223 | 8/1971 | Glick et al. | 134/31 |
| 3,736,646 | 6/1973 | Schmitt et al. | 128/339 X |

*Primary Examiner*—Murray Tillman
*Assistant Examiner*—T. De Benedictis, Sr.
*Attorney, Agent, or Firm*—Frank M. Van Riet

[57] ABSTRACT

A fiber finish for absorbable glycolic acid polymer fiber which consists of a mixture of a specific class of pharmaceutical grade light mineral oils and sorbitan monolaurate in xylene, and a method of finishing such fibers.

6 Claims, No Drawings

POLYGLYCOLIC ACID FIBER FINISH AND METHOD

BACKGROUND OF THE INVENTION

The demand for absorbable fibers which can be processed into structures such as sutures, dressings, hemostats etc. has been increasing extensively over the past decade. The use of catgut sutures is therefore waning. Consequently, the manufacture of absorbable synthetic fibers has been materially increased and methods of improving such manufacturing techniques has been the subject of continued and extensive research.

Glycolic acid polymer fibers have received wide recognition in recent years and, as such, the demand therefor has increased proportionately. As a result, new processing and manufacturing facilities have been erected and existing facilities have been expanded. Short of these two solutions to the problem of meeting the demand has been the revision and up-grading of the technology in the existing manufacturing procedures. In the manufacture of glycolic acid polymer sutures, many steps must be followed between the polymer production, through fiber manufacture and finally to the finished medical product, e.g. a suture. One of the primary problems in the fiber manufacture has been the increasingly large volume of material produced which must be discarded. An unusually large amount of material falls into this category because the products possess too many flaws, slubs, neps etc. resulting from passage of the fiber through the processing machinery e.g. braiding apparatus etc. Additionally, a problem has also existed with regard to the final washing of the filaments and on braids, etc., produced (see U.S. Pat. No. 3,600,223) wherein water-washing, as it is known with regard to most other fibrous materials, is replaced by ultrasonic solvent washing because of the sensitivity of the glycolic acid polymer fiber to water.

In the past, processing problems of the type described above with regard to textile treating have been solved by applying lubricants to the fibers being processed, see U.S. Pat. Nos. 2,575,576; 3,101,990; 3,568,279. While these additive finishes solved the processing problems of the art, they nevertheless generally created more of a problem subsequent to the processing steps because the finishes added then had to be removed. If, however, water did not remove these additives, various manipulative procedures had to be followed such as adding detergents or subjecting the fiber to more than one bath. As mentioned above, however, water washing cannot be effected in glycolic acid polymer sutures.

SUMMARY OF THE INVENTION

We have now discovered that glycolic acid polymer fibers can be treated with a finishing material which allows the fibers to be processed with minimum filament breaks. Because of the nature of the glycolic acid polymer per se, i.e. its water-sensitivity, the fibers have, as mentioned above, always been washed ultrasonically in a solvent bath. One of these preferred solvents has been xylene. Applicants have now discovered that a mixture of a particular class of pharmaceutical grade light mineral oil and sorbitan monolaurate have the ability to not only afford a processing finish to glycolic acid polymer fibers but, since they are soluble in xylene, they can be applied to the fiber from a solution thereof and, furthermore, any of the components of the finishing mixture which remain on the fiber after processing can be readily removed therefrom in the ultrasonic xylene washing bath, generally without added surfactant.

As a result, not only are the fibers, yarns, braids etc. more consistent in quality, but the heat transfer through them during drawtwisting, for example, is improved thereby allowing heavier deniers to be processed. Furthermore, the unique finish of the instant invention minimizes static and obviates the need for static eliminators. Since all the components of the finish have been subjected to F.D.A. approval, the resultant fibers may be used for many medical purposes.

DESCRIPTION OF THE INVENTION INCLUDING PREFERRED EMBODIMENTS

As mentioned briefly above, we have now discovered a hydrophobic, biologically innocuous, fiber finish for absorbable glycolic acid polymer fibers consisting essentially of a xylene solution of a mixture of (1) from about 10% to about 90% of a pharmaceutical grade light mineral oil having an API Gravity of from about 31.1 to about 40.2, a Specific Gravity at 25°C. (USP) of from about 0.824 to about 0.870, a Viscosity at 100°F., SSU of from about 48 to about 105 and a Refractive Index at 25°C. of from about 1.456 to about 1.469 and, correspondingly, (2) from about 90% to about 10%, of sorbitan monolaurate, said percentages being by weight based on the total weight of (1) and (2).

In a preferred embodiment, the light mineral oil and the sorbitan monolaurate are each present in the mixture at a concentration of about 50.0%.

The concentration of the light mineral oil and the sorbitan monolaurate mixture in the xylene can range from about 3.0% to about 25.0%, by weight, based on the total weight of the solution, preferably from about 5% to about 15.0%, by weight, same basis.

By "absorbable glycolic acid polymers" or "glycolic acid polymers" as used herein and in the appended claims, is meant homopolymeric glycolic acid and glycolic acid polymers containing other chain linkages, such as those obtained from D- or L-lactic acid, its optically active forms, homologs or analogs, and also containing from about 0.05 to about 1.5 mole percent, based on the glycolide, of an alcohol free of non-benzenoid unsaturation and devoid of any reactive groups other than alcoholic hydroxy groups, see U.S. Pat. No. 3,442,871, incorporated herein by reference.

Light mineral oils which conform to the requirements specified above are commercially available. Examples of oils useful herein include the oils manufactured by the Pennsylvania Refining Company under the tradename Drakeoil. These Drakeoils are identified by such designations as Drakeoil 6, Drakeoil 6-VR, Drakeoil 10 etc. One Drakeoil which has been found to be especially suitable herein is that designated as Drakeoil 6-VR which has an API Specific Gravity of 36.2–36.8, a Specific Gravity at 25°C. (USP) of 0.834–0.838, a Viscosity at 100°F., SSU of 59–61 and a Refractive Index at 25°C. of 1.458–1.463.

Mineral oil fractions such as Drakeoil 35 which has an API Gravity, a Specific Gravity at 25°C. (USP), a Viscosity at 100°F. SSU and a Refractive Index of 27.8–29.3; 0.880–0.888; 340–365 and 1.480, respectively, can be used for processing very heavy fibers of a denier of greater than about 15 etc., although such are not generally preferred.

The sorbitan monolaurate component of our novel fiber finishes is also well known and available commercially. It is a known surfactant and generally is made available by Atlas Industries under the tradename Span 20. It is a nonionic emulsifier which, at 25°C., is an amber, oily liquid. It has a Specific Gravity at 25°C./25°C. of approximately 1.0, a Viscosity at 25°C. of approximately 4250 cps., a Flash Point above 300°F. and is soluble in xylene. Although it is generally identified as sorbitan monolaurate it actually is a mixture of primarily $C_{12}$ and $C_{14}$ monoesters with smaller amounts of $C_8$, $C_{10}$, $C_{16}$ and $C_{18}$ mono, di and triesters with additional minor amounts of non-esters. It is produced by reacting sorbitol with coconut oil which contains many $C_6$–$C_{18}$ fatty acids and, hence, results in the production of the mixture of esters. However, when the term "sorbitan monolaurate" is used herein and in the appended claims, the pure monoester as well as ester mixtures such as specified above are intended, with the amount of $C_{12}$ and $C_{14}$ monoesters comprising at least about 60% of the mixture. Arlacel 20 is also another commercial product which conforms to the above requirements and can be used herein. It also is manufactured by Atlas Industries and differs from Span 20 in that it is treated by contacting it with activated carbon.

The mixture of the light mineral oil and sorbitan monolaurate should be applied to the fiber of the glycolic acid polymer prior to processing it in amounts ranging from about 0.25% to about 4.0%, by weight, based on the weight of the fiber.

In practice, the mixture of the light mineral oil and sorbitan monolaurate in xylene is applied to the glycolic acid polymer filament or fiber as it is extruded from the extruder i.e. after extrusion and as soon as the filaments are cool. The application of the finish to the yarn is accomplished generally by the use of a kiss roll, the amount of finish being applied within the above specified limits by adjusting the roll speed and contact angle as is known in the art. The kiss roll is constantly covered with the liquid finish by rotating through a reservoir thereof.

After the finish is applied to the yarn, the glycolic acid polymer yarns are collected, and then may be treated in a manner known to those skilled in the art in the production of textile structures, such as sutures, ligatures, braids, bandages, felts, velours, fabrics, etc. which are woven, braided or knitted. The finish material, as mentioned above, enables the fiber to be processed through the textile equipment to thereby result in a more uniform product substantially free of snags, slubs, neps etc. Such textile processing apparatus usually consists of braiding apparatus with various other apparatus for washings, heat and densification treatments, stretchings etc. following.

A unique feature of our novel finishing material is that the xylene and/or light mineral oil are essentially removed either before or during the process steps which require heat because of the volatility of these components. Therefore, ultimate solvent washing steps either reduce the content of the finish to a value which is in accordance with specified standards or need not be used at all. It is generally accepted, however, that washing is necessary in order to remove machinery oils etc. added to the fibers during processing. Ultrasonic xylene washing at from about room temperature to about 80°C. accomplishes this result, the fibers which have been contacted with our novel finishing composition being more easily cleaned than if other commercially available finishes were used.

The following examples are set forth for purposes of illustration only and are not to be construed as limitations on the instant invention except as set forth in the appended claims. All parts and percentages are by weight unless otherwise specified.

EXAMPLE 1

Polyglycolic acid prepared as in U.S. Pat. No. 3,297,033 is extruded through a melt spinning system consisting of a ¾ inch diameter screw extruder, a cross head equipped with a gear type metering pump, a filter on the outlet side of the pump, and finally a spinneret containing sixteen 0.016 inch diameter holes, at a rate of 22.7 grams per minute. The molten filaments are quenched by cross flowing ambient air. Finish (as defined in Table I) is applied to the cooled filament yarn using a standard counter rotating kiss roll technique just prior to passage over a multiple roll assembly for final speed control and then the yarn is collected on a standard textile winder at 1675 feet per minute.

The undrawn yarn, as collected above, is drawn and twisted on a standard commercial draw twister operating at an overall draw ratio of 4.0X and a draw temperature of 140°F. The resultant yarn is 50 denier/8 fil and 100 denier/16 fil with good physical strength, e.g. 6.5 grams per denier tenacity and 30% elongation at break. The percent yield through draw twisting and final braid quality as well as results utilizing varying conditions and finish component concentrations are set forth in Table I, below.

TABLE I

| | Finish Applied to Fiber | | | | | |
|---|---|---|---|---|---|---|
| Example No. | Composition SML/MO | Composition Level in Xylene, % Wt | Finish Roll Surface Velocity, fpm | Total Finish Concentration on Undrawn Yarn, % Wt | % Yield Through Drawtwisting, % Wt * | Final Braid Quality, Knots/100 Yds. |
| 1 | 50/50 | 17 | 63 | ~2 | 93 | 0.36 |
| 2 | 50/50 | 17 | 37 | ~1 | 94 | 0.66 |
| 3 | 50/50 | 17 | 94 | ~4 | 95 | 0.33 |
| 4C | 0/0 | — | 70 | — | 80 | 2.20 |
| 5 | 20/80 | 24 | 63 | ~2 | 90 | 0.60 |
| 6C | 100/0 | 10 | 37 | ~1 | 94 | 0.27 |
| 7C | 100/0 | 10 | 63 | ~2 | 91 | 0.73 |
| 8C | 100/0 | 10 | 94 | ~4 | 91 | 0.48 |

$$*\% \text{ Yield} = \frac{\text{Gms. Drawtwisted Fiber Out}}{\text{Gms. Undrawn Fiber In}} \times 100$$

C = Comparative

SML = sorbitan monolaurate (Span 20)

TABLE I-continued

| Example No. | Finish Applied to Fiber: Composition SML/MO | Composition Level in Xylene, % Wt | Finish Roll Surface Velocity, fpm | Total Finish Concentration on Undrawn Yarn, % Wt | % Yield Through Drawtwisting, % Wt * | Final Braid Quality, Knots/100 Yds. |
|---|---|---|---|---|---|---|

MO = Drakeoil 6-VR (mineral oil)

EXAMPLES 9 and 10

The procedure of Example 1 is again followed except that the mineral oil is (9) Drakeoil 6 and (10) Drakeoil 10. Substantially identical results are obtained. Drakeoil 6 has an API Gravity of 40.2–37.6, a Specific Gravity (USP) at 25°C. of 0.824–0.837, a Viscosity at 100°F. SSU of 48–52 and a Refractive Index at 25°C. of 1.456. Drakeoil 10 has an API Gravity of 35.0–31.0, a Specific Gravity (USP) at 25°C. of 0.850–0.870, a Viscosity at 100°F. SSU of 95–105 and a Refractive Index at 25°C. of 1.469.

EXAMPLES 11–13

When the sorbitan monolaurate of Examples 1, 9 and 10 is replaced by that sold commercially as Arlacel 20, similar results are achieved.

carrier machine. Two ends are fed in as a core. Approximately two thousand yards of braid are produced in each example, each of which are inspected for visual defects and portions used for analytical determinations of finish levels. The remaining braid is then divided into two portions; one washed in an ultrasonic washer with xylol (as in U.S. Pat. No. 3,600,223) and rinsed before a standard braid finishing operation which involves the application of heat (post treatment — 3 hours under vacuum at 100°–150°C. and 1.0 mm absolute pressure) and the other ultrasonically washed in xylene after braid finishing. The samples are then analyzed and physically tested. The results are set forth in Tables II and III. The results in Table II show that our novel finish composition has no deleterious effect on glycolic polymer yarn while those in Table III show that washing substantially completely removes the finish.

TABLE II

| Yarn of Example No. | Tensile Strength — PSI: Yarn Washed before Post Treatment: Straight Pull | Knot Pull | Yarn Post Treated Then Washed: Straight Pull | Knot Pull | Yarn Post Treated — Incubated at 56°C. for 6 weeks: Straight Pull | Knot Pull |
|---|---|---|---|---|---|---|
| 1 | 80,100 | 48,300 | 79,100 | 49,800 | — | — |
| 2 | 81,900 | 46,200 | 82,700 | 50,400 | — | — |
| 3 | 83,000 | 41,400 | 84,800 | 49,100 | 85,600 | 55,100 |
| 4C | 92,000 | 54,500 | 92,000 | 54,500 | 87,300 | 58,300 |
| 5 | 89,000 | 55,200 | 82,400 | 49,800 | — | — |
| 6C | 86,700 | 46,800 | 82,600 | 48,700 | — | — |
| 7C | 85,500 | 52,500 | 89,300 | 53,300 | — | — |
| 8C | 83,400 | 55,000 | 80,700 | 48,600 | 85,900 | 55,000 |

TABLE III

| Yarn of Example No. | CONCENTRATION OF FINISH IN YARN: Yarn As Braided: % SML | % MO | Yarn Washed Before Post Treatment: % SML | % MO | Yarn Washed After Post Treatment: % SML | % MO |
|---|---|---|---|---|---|---|
| 1 | .99 | .05 | .002 | <.001 | .003 | <.001 |
| 2 | .41 | .14 | <.001 | <.001 | .001 | <.001 |
| 3 | 1.32 | .007 | .002 | <.001 | .003 | <.001 |
| 4C | .01* | .002* | — | — | — | — |
| 5 | .63 | .29 | <.001 | <.001 | .003 | <.001 |
| 6C | .58 | .02* | .003 | — | .001 | — |
| 7C | 1.67 | .04* | .003 | — | .004 | — |
| 8C | 1.74 | .05* | .003 | — | .008 | — |

See Table I for SML and MO definitions

* = picked up from apparatus — not intentionally applied to yarn

EXAMPLE 14

The procedure of Example 5 is again followed except that the SML/MO ratio is 80/20. The final braid quality shows 0.64 knots per 100 yards of yarn. Other properties are substantially identical.

EXAMPLES 15–22

A. The yarns described in Examples 1–8 are transferred to carrier bobbins and braided on a standard 8

B. Concurrently, braid is manufactured from finish containing yarns intentionally grossly soiled with braider lubricants. The soiled material is then subjected to the braid finishing operations described in paragraph (A) i.e., washing and post treatment. Spectrophotometric measurements from which Lightness values (calculated from tristimulus values in the yellow/green visual region) could be determined, are taken before and after washing and compared to a non-soiled control. The results are set forth in Table IV.

TABLE IV

| Yarn of Example No. | SML/MO | Finish Conc. | % SML Analysis | LIGHTNESS VALUES ($10\sqrt{Ycie}$) Non-Soiled Control After Wash | Soiled Specimens After Wash | Soiled Specimens Before Wash |
|---|---|---|---|---|---|---|
| 1 | 50/50 | ~2 | .99 | 63.8 | 61.5 | 50.5 |
| 2 | " | ~1 | .91 | 62.9 | 61.7 | 53.1 |
| 3 | " | ~4 | 1.32 | 62.9 | 61.0 | 52.2 |
| 4C | 0 | — | — | 60.0 | 54.3 | 49.4 |
| 5 | 20/80 | ~2 | .63 | — | — | |
| 6C | 100/0 | ~1 | .58 | — | — | — |
| 7C | " | ~2 | 1.67 | 62.6 | 62.5 | 52.6 |
| 8C | " | ~4 | 1.74 | 63.4 | 61.8 | 50.9 |

EXAMPLE 23

The procedure of Example 1 is again followed except that the glycolic acid polymer contains about 5 mole percent of L-lactic acid. Again substantially identical results are achieved in knot reduction.

We claim:

1. A hydrophobic, biologically innocuous, fiber finish for absorbable glycolic acid polymer fiber consisting essentially of a xylene solution of a mixture of (1) from about 20% to about 80% of a pharmaceutical grade light mineral oil having an API Gravity of from about 31.1 to about 40.2, a Specific Gravity at 25°C. (USP) of from about 0.824 to about 0.870, a Viscosity at 100°F., SSU of from about 48 to about 105 and a Refractive Index at 25°C. of from about 1.456 to about 1.469 and, correspondingly, (2) from about 80% to about 20% of sorbitan monolaurate, said percentages being by weight based on the total weight of (1) and (2), the concentration of said mixture in said solution ranging from about 3% to about 25%, by weight, based on the total weight of the solution.

2. A fiber finish according to claim 1 wherein (1) and (2) are each present in said mixture at a concentration of about 50.0%.

3. A fiber finish according to claim 1 wherein the concentration of said mixture in xylene ranges from about 5% to about 15%.

4. A method of finishing an absorbable glycolic acid polymer fiber which comprises applying to said filament from about 0.25% to about 4.0%, by weight, based on the total weight of said filament, of the solution of claim 1.

5. A method according to claim 4 wherein (1) and (2) are each present in said mixture at a concentration of about 50%.

6. A method according to claim 4 wherein the concentration of said mixture in xylene ranges from about 5% to about 15%.

* * * * *